US008596695B2

(12) United States Patent
Inan

(10) Patent No.: US 8,596,695 B2
(45) Date of Patent: Dec. 3, 2013

(54) MOTOR VEHICLE DOOR LOCK

(75) Inventor: Ömer Inan, Dorsten (DE)

(73) Assignee: Kiekert AG, Heiligenhaus (DE)

( * ) Notice: Subject to any disclaimer, the term of this patent is extended or adjusted under 35 U.S.C. 154(b) by 1111 days.

(21) Appl. No.: 12/159,617

(22) PCT Filed: Dec. 20, 2006

(86) PCT No.: PCT/DE2006/002281

§ 371 (c)(1),
(2), (4) Date: Jun. 28, 2008

(87) PCT Pub. No.: WO2007/073723

PCT Pub. Date: Jul. 5, 2007

(65) Prior Publication Data

US 2009/0021027 A1 Jan. 22, 2009

(30) Foreign Application Priority Data

Dec. 29, 2005 (DE) ..... 20 2005 020 452 U

(51) Int. Cl.
*E05C 3/06* (2006.01)

(52) U.S. Cl.
USPC ..... 292/216; 292/DIG. 56

(58) Field of Classification Search
USPC ..... 292/DIG. 49, DIG. 56
See application file for complete search history.

(56) References Cited

U.S. PATENT DOCUMENTS

| | | | | | |
|---|---|---|---|---|---|
| 2,016,519 | A | * | 10/1935 | Schmidt | 292/78 |
| 2,598,245 | A | * | 5/1952 | Firman | 74/469 |
| 3,705,738 | A | | 12/1972 | Yoshimura | |
| 3,722,937 | A | * | 3/1973 | Stoeckl | 292/79 |
| 4,036,517 | A | * | 7/1977 | Talmadge | 292/216 |
| 4,657,292 | A | * | 4/1987 | Bruck | 292/80 |
| 4,794,669 | A | * | 1/1989 | Sanders | 16/341 |
| 5,413,317 | A | * | 5/1995 | Spoerre | 267/134 |
| 5,984,384 | A | * | 11/1999 | Hamaguchi et al. | 292/216 |
| 6,880,204 | B2 | * | 4/2005 | Ochiai | 16/82 |
| 7,552,953 | B2 | * | 6/2009 | Schmoll et al. | 292/267 |

FOREIGN PATENT DOCUMENTS

| | | | |
|---|---|---|---|
| DE | 20 48 206 | A1 | 5/1971 |
| JP | 5-156854 | A | 6/1993 |
| JP | 2000-274131 | A | 10/2000 |

* cited by examiner

*Primary Examiner* — Gary Estremsky
(74) *Attorney, Agent, or Firm* — Renner, Otto, Boisselle & Sklar, LLP

(57) ABSTRACT

A vehicle door latch with a locking mechanism (1, 2) comprising mainly a catch (1) and a pawl (2), and with a locking mechanism shock absorber (8). The locking mechanism shock absorber (8) and the respective locking mechanism stops (10, 11) restrict an opening as well as a closing movement of the locking mechanism (1, 2). In a particular embodiment, the locking mechanism shock absorber (8) is designed as a revolving shock absorber rotatably disposed in the frame box (6) and/or latch housing.

11 Claims, 3 Drawing Sheets

MOTOR VEHICLE DOOR LOCK

CROSS-REFERENCE TO RELATED APPLICATIONS

This is a National Stage Application of International Patent Application No. PCT/DE2006/002281, with an international filing date of Dec. 20, 2006, which is based on German Patent Application No. 20 2005 020 452.8, filed Dec. 29, 2005. The contents of both of these specifications are incorporated herein by reference.

BACKGROUND OF THE INVENTION

1. Field of the Invention

The invention relates to a vehicle door latch with a locking mechanism comprising mainly a catch and a pawl and a locking mechanism shock absorber.

2. Description of the Prior Art

Vehicle door latches of the above design are described, for instance, in DE 2 048 206. As described therein, the locking mechanism shock absorber ensures that the opening movement of the associated catch is restricted. In addition, for example, from DE 103 24 339 A1, it is also known that an elastic overtravel stop device can be used that also contains a shock absorber stop. A similar solution is described in DE 20 2005 010 526 U1.

Conventional solutions have generally been found advantageous in systems where the opening movement or the closing movement of the locking mechanism is to be restricted. These solutions are, however, not fully satisfactory. The systems still produce unwanted latch noises, predominately caused by the opening and/or closing of the locking mechanism. This invention aims to remedy such problems.

The invention is based on the technical problem of further developing a vehicle door latch of the above design in such a way that latch noises are reliably suppressed, in particular during opening and closing.

BRIEF DESCRIPTION OF THE INVENTION

In order to solve this problem a generic vehicle door latch is provided in which a (single) locking mechanism shock absorber limits the opening movement as well as the closing movement of the locking mechanism in cooperation with the respective locking mechanism stops.

At the same time the locking mechanism shock absorber ensures that latch noises are at least reduced during the opening and closing movements of the locking mechanism by absorbing the respective energies. For this purpose, the locking mechanism shock absorber is generally made from an elastomeric plastic, and thus reliably reduces noises created by the opening and closing movements of the locking mechanism.

In this context it was found advantageous to design the locking mechanism shock absorber as a revolving shock absorber pivotally-disposed in the frame box and/or the latch housing. The locking mechanism shock absorber may also contain an axis of rotation connected to the frame box and/or the latch housing and made from, for instance, steel. The axis of rotation is either directly connected to the frame box or the latch housing or can, for instance, be riveted, bolted or connected in other ways to the aforementioned elements. In order to restrict the closing movement of the locking mechanism, the locking mechanism shock absorber generally limits the overtravel of the locking mechanism. In other words, the locking mechanism shock absorber acts on the one hand advantageously as an opening stop and on the other hand as an overtravel stop, in each case acting together with the respective locking mechanism stop.

The locking mechanism stops are, in each case, provided on the catch and in one case as opening stop and in the other case as overtravel stop. The locking mechanism shock absorber is advantageously a circular wheel made from an elastomer. This circular wheel contains a central hole into which the axis of rotation arranged on the frame box and/or latch housing engages. Plastics such as acrylic rubber (ACM), acrylonitrile-butadiene rubber (NBR), chloroprene rubber (CR), ethylene-acrylate rubber (EAM), ethylene-propylene rubber (EPDM), natural rubber (NR), or also styrene-butadiene rubber (SBR) are predominantly used as the elastomer, although this does not represent and does not have to represent all materials that can potentially be used.

To further reduce possible noises of the locking mechanism between the opening position and the closing position and/or the overtravel position, the locking mechanism shock absorber fully or partially enters a path of movement of the locking mechanism between the two locking mechanism stops. This path of movement of the locking mechanism is usually traced by the external contour of the catch with which the locking mechanism shock absorber is in rolling contact. In this case, i.e., along the path of the movement, the locking mechanism shock absorber is only rotationally acted upon and carries out no or only little flexing work. However, in the area of the locking mechanism stops the locking mechanism shock absorber is also elastically-deformed and compressed. At the same time, resultant counter forces acting on the locking mechanism increase disproportionally with increasing actuating distance.

In general, embodiments of the invention achieve this in that the locking mechanism stops are basically in each case of an arch-shaped design with a radius adapted to the diameter of the locking mechanism shock absorber and advantageously contain a flank rising in relation to the path of movement. This flank ensures that the locking mechanism shock absorber is increasingly deformed in the respective end position (opening or closing position or overtravel position).

As a result, a vehicle door latch is provided whose (sole) locking mechanism shock absorber limits the opening movement as well as the closing movement and the overtravel movement of the locking mechanism, and does so in cooperation with the corresponding locking mechanism stops. In both end positions, the elastic deformation of the locking mechanism shock absorbers produces the desired energy absorption and thus noise reduction. In particular, this reduces the unwanted noises produced in the closed position and/or the overtravel area, which are frequently experienced in conventional solutions.

The comfort factor and the noise level are considerably improved as a result. In addition, the locking mechanism shock absorber advantageously ensures noise reductions during the entire movement of the locking mechanism: during opening and closing of the latch and in-between these two positions, because the locking mechanism shock absorber also fully or partially enters the path of movement of the locking mechanism between the two locking mechanism stops. These are the main advantages of the invention.

BRIEF DESCRIPTION OF THE DRAWINGS

Below the invention is explained in more detail with reference to figures representing only one embodiment of the invention, in which.

DETAILED DESCRIPTION OF THE INVENTION

Figure 1:
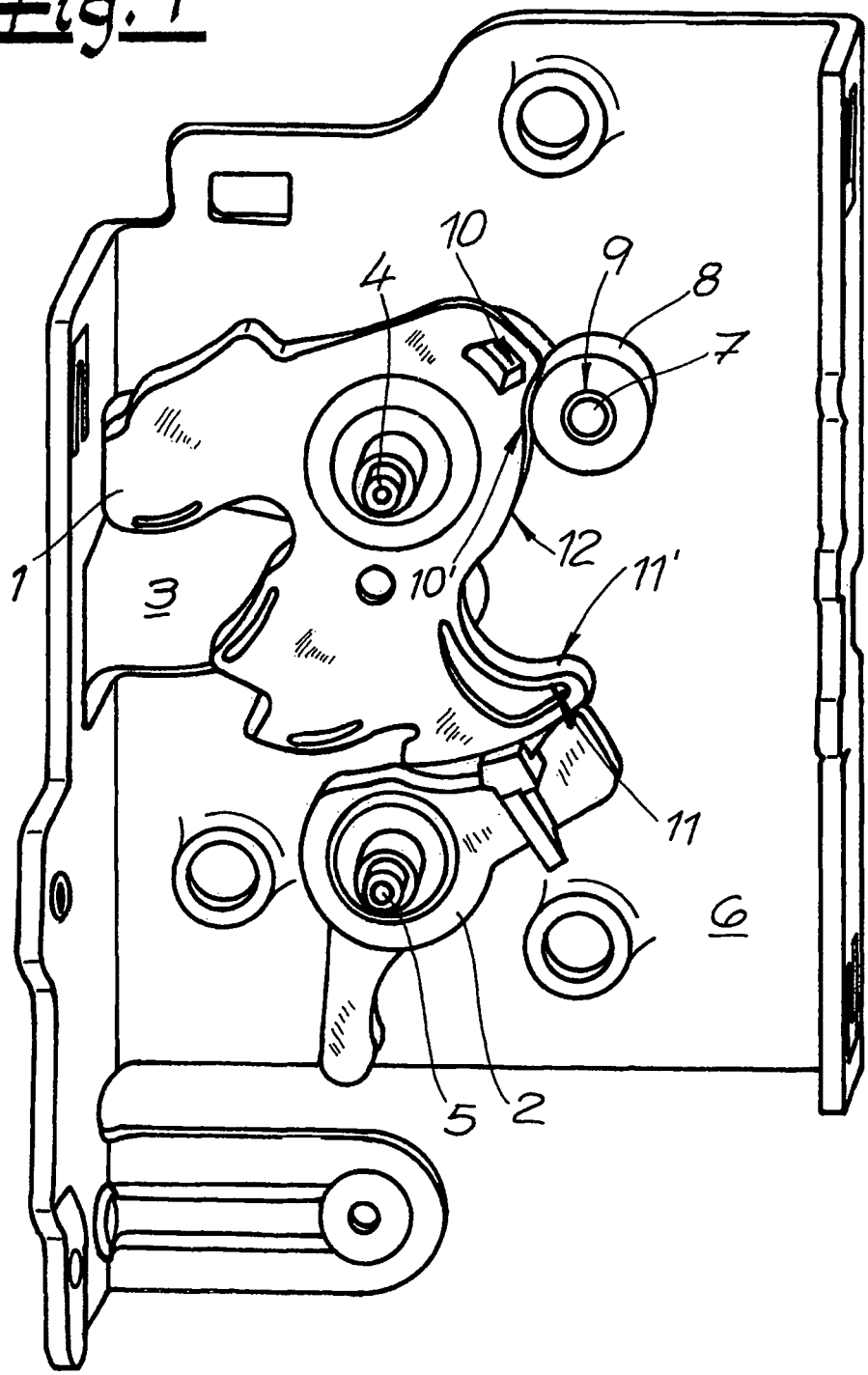
FIG. 1 shows the vehicle door latch according to one embodiment of the invention in its open position.

The figures show a vehicle door latch 13 with a usual locking mechanism comprising a catch 1 and a pawl 2. The catch 1 interacts with a locking pin—not shown—moving the catch 1 from its open position in FIG. 1 into its closed position in FIG. 2 by engaging into a respective intake opening 3 and moving the catch 1 around its axis of rotation 4 during the transition from FIG. 1 to FIG. 2 in the anti-clockwise direction. It is apparent that catch 1 with its axis of rotation 4 and also pawl 2 with its axis of rotation 5 are each arranged in a frame box 6 having a U-shaped cross section.

The frame box 6 is not necessarily U-shaped and provides the base for or accommodates an axis of rotation 7, rotatably accommodating a locking mechanism shock absorber 8. The axis of rotation 7 is actually part of the frame box 6 or is riveted, bolted or connected in a similar fashion to the frame box 6. The axis of rotation 7 runs through a central hole 9 in the locking mechanism shock absorber 8, which in this embodiment is shown as a circular wheel made from an elastomeric plastic, although the invention is not limited to this design.

The locking mechanism shock absorber 8 interacts in the two end positions of the locking mechanism 1, 2 with the respective contours of the catch 1. For this purpose, locking mechanism stops 10, 11 are provided on catch 1. In principle, one or two locking mechanism stops 10, 11 can also be provided on pawl 2, although this is not illustrated in the figures.

In cooperation with the locking mechanism shock absorber 8, the respective locking mechanism stops 10, 11 ensure that both the opening movement as well as the closing movement of the locking mechanism 1, 2 are restricted. In order to achieve this, the locking mechanism shock absorber 8 is designed as a revolving shock absorber rotatably disposed in the frame box 6. The locking mechanism shock absorber 8 could also, or could alternatively, be arranged in a latch housing—not shown.

Figure 2:
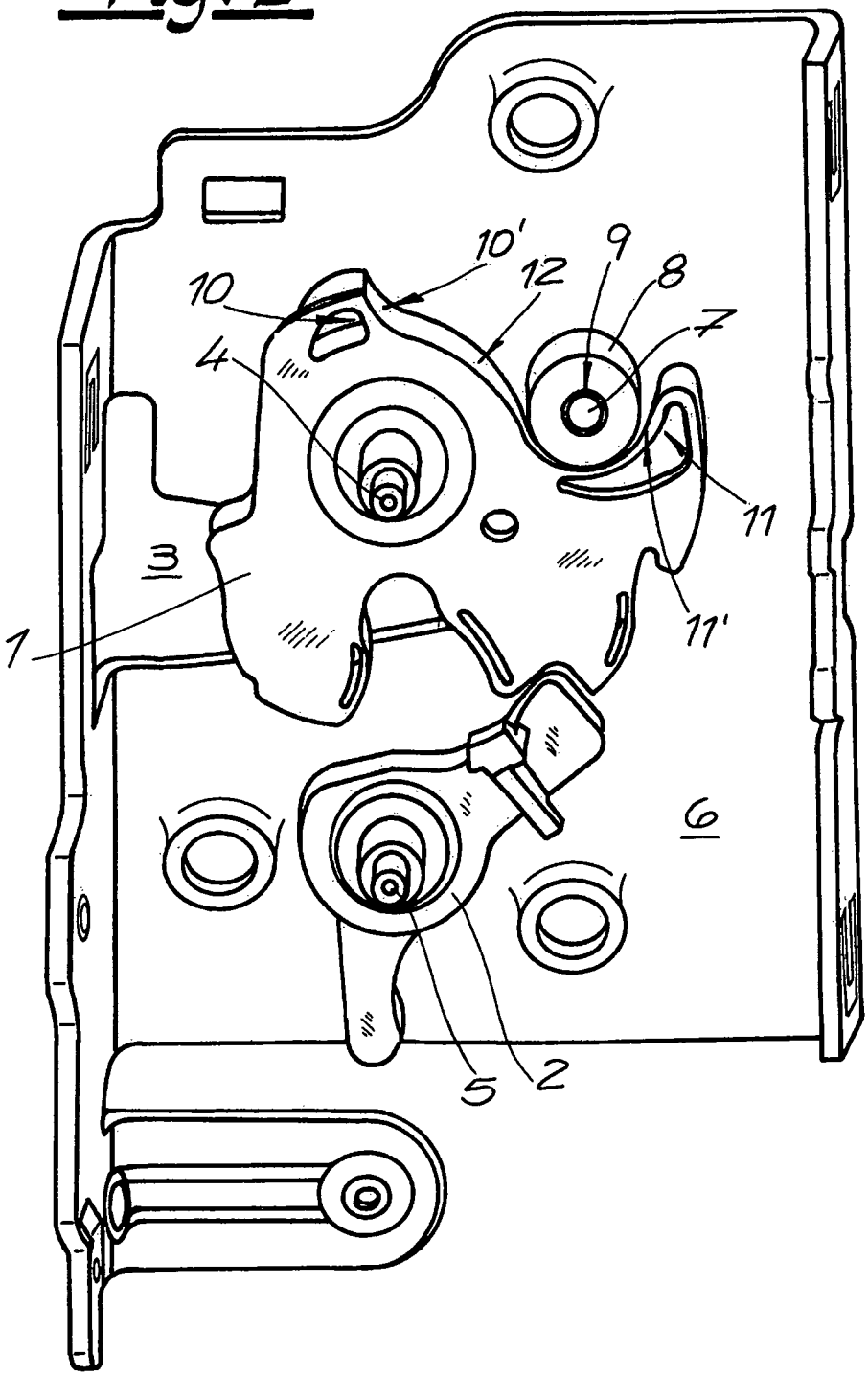
FIG. 2 shows the embodiment of the invention of FIG. 1 in its fully closed position.
Figure 3:
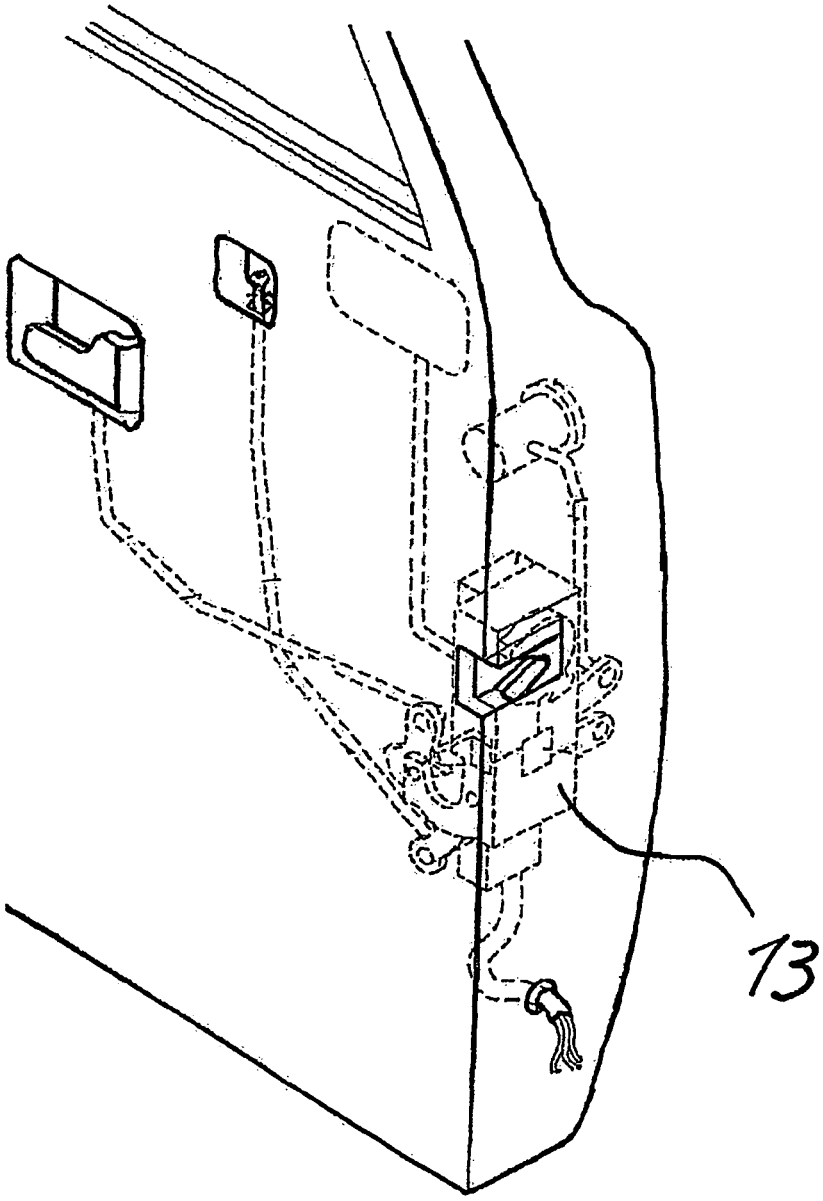
FIG. 3 shows the embodiment of the invention of FIGS. 1 and 2 implemented in a vehicle door.

Although the invention is not limited to this, the embodiment shows a locking mechanism shock absorber 8 restricting on the one hand the opening movement of catch 1 as shown in FIG. 1. Actually, a spring—not shown—acts in the clockwise direction on the catch 1 with this opening movement being restricted by the interaction between the locking mechanism stop 10 and the locking mechanism shock absorber 8. The locking mechanism stop 10 is thus an opening stop 10. On the other hand, the locking mechanism shock absorber 8 ensures together with the other locking mechanism stop 11 that the closing movements of the locking mechanism 1, 2 are also restricted. The locking mechanism stop 11 acts in this context also as an overtravel stop 11.

The opening stop 10 and the locking mechanism shock absorber 8 together form an opening stop device 8, 10, and the overtravel stop 11 and the locking mechanism shock absorber 8 together forming an overtravel stop device 8, 11. The overtravel results—as is generally known—in catch 1 being moved from its fully closed position shown in FIG. 2 around its axis of rotation 4 in the anti-clockwise direction. In order to restrict this movement, the overtravel stop 11 and the locking mechanism shock absorber 8 cooperate as overtravel stop device 8, 11.

The opening stop device 8, 10 and the overtravel stop device 8, 11 are characterized in that the respective locking mechanism stops 10, 11 have in each case an arch-shaped design with a radius adapted to the diameter of the locking mechanism shock absorber 8. The locking mechanism stops 10, 11 also contain a flank 10', 11' rising in relation to the path of movement 12, increasingly deforming the locking mechanism shock absorber 8 in the respective end position (open or closed position). This means that the respective rising flank 10', 11' of the respective locking mechanism stop 10, 11 ensures that the locking mechanism shock absorber 8 produces disproportionately-increasing counter forces during the period of its deformation by the respective stop 10, 11.

Although the invention is not limited to this, the described embodiment shows that the locking mechanism shock absorber 8 is also in rolling contact along the path of the movement 12 between the two end positions. During this movement the locking mechanism shock absorber 8 is mainly rotationally being acted upon by turning around its axis of rotation 7. The locking mechanism shock absorber 8 on the other hand hardly carries out any deformation or flexing work. The locking mechanism shock absorber 8 on the other hand practically does not experience, or does no longer experience, any rotational force in the area around the locking mechanism stops 10, 11, but is mainly elastically-deformed at this point and disproportionately so with the increasing distance of the displacement. As a result, progressively-increasing counter forces are generated by the locking mechanism shock absorber 8 in the open and closed position and in the overtravel area. Consequently the distance of displacement of the locking mechanism 1, 2 is effectively restricted and the noise is reduced considerably.

The invention claimed is:

1. A vehicle door latch for mounting on one of a movable closure and the vehicle, comprising:

a catch for latching engagement with a locking pin mounted on the other of the movable closure and the vehicle, the catch having a first stop and a second stop on its peripheral edge, said catch being pivotally mounted to a latch housing for opening and closing movement such that the first stop moves along a first path upon opening movement of the catch in a first direction and the second stop moves along a second path during closing movement of the catch in a second direction opposite the first direction, and a shock absorber formed from an elastically deformable material mounted to the latch housing to be in rolling contact with the periphery of the catch, the shock absorber being positioned in the first path for engagement by the first stop such that the shock absorber, in use, restricts opening movement of said catch by engaging with said first stop and elastically deforms to absorb shock arising from the first stop engaging the shock absorber, and the shock absorber also being positioned in the second path for engagement by the second stop such that the shock absorber, in use, restricts closing movement of said catch by engaging with said second stop and elastically deforms to absorb shock arising from the second stop engaging the shock absorber.

2. The latch of claim 1, wherein the shock absorber is in rolling contact with said peripheral edge of the catch between said first stop and said second stop.

3. The latch of claim 2, wherein said shock absorber is positioned such that the shock absorber is engaged with said catch during the entire opening movement and during the entire closing movement of the catch, whereby in use vibrations or noise of the latch are reduced.

4. The latch of claim 2, wherein said shock absorber engages with said catch during an entire opening stroke and during an entire closing stroke.

5. The latch of claim 1, wherein the elastically deformable material is substantially elastomeric plastic.

6. The latch of claim 1, wherein said first stop and said second stop are each arc-shaped and each has a curvature corresponding to a curvature of said shock absorber.

7. The latch of claim 6, wherein the first stop has a first rising flank and the second stop has a second rising flank such that when said shock absorber is elastically deformed in use, said shock absorber experiences progressively-increasing and disproportionately-increasing deformation forces with respect to a period of deformation of said shock absorber during said opening movement as a result of interacting with said first rising flank and said shock absorber experiences progressively-increasing and disproportionately increasing deformation forces with respect to a period of deformation of said shock absorber during said closing movement as a result of interacting with said second rising flank.

8. The latch of claim 1, wherein the first stop has a first rising flank and the second stop has a second rising flank such that when said shock absorber is elastically deformed in use, said shock absorber experiences progressively-increasing and disproportionately-increasing deformation forces with respect to a period of deformation of said shock absorber during said opening movement as a result of interacting with said first rising flank and said shock absorber experiences progressively-increasing and disproportionately increasing deformation forces with respect to a period of deformation of said shock absorber during said closing movement as a result of interacting with said second rising flank.

9. The latch of claim 8, wherein said shock absorber engages with said catch during an entire opening stroke and during an entire closing stroke.

10. The latch of claim 8, wherein said catch comprises an intake opening adapted for engaging with the locking pin attached to a vehicle frame during said closing movement.

11. The latch of claim 1, wherein said catch comprises an intake opening adapted for engaging with the locking pin attached to a vehicle frame during said closing movement.

* * * * *

UNITED STATES PATENT AND TRADEMARK OFFICE

CERTIFICATE OF CORRECTION

PATENT NO. : 8,596,695 B2
APPLICATION NO. : 12/159617
DATED : December 3, 2013
INVENTOR(S) : Ömer Inan It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1250 days.

Signed and Sealed this
Twenty-second Day of September, 2015

Michelle K. Lee

Michelle K. Lee
*Director of the United States Patent and Trademark Office*